US012797680B2

(12) United States Patent
Kim et al.

(10) Patent No.: US 12,797,680 B2
(45) **Date of Patent: *Nov. 17, 2026**

(54) COMBINATION LEG PRESS AND HIP THRUST EXERCISE MACHINE

(71) Applicant: Fitness Forward Innovations, Inc., Garden Grove, CA (US)

(72) Inventors: Alexander Kim, Valencia, CA (US); Leo Chang, Garden Grove, CA (US)

(73) Assignee: Fitness Forward Innovations, Inc., Garden Grove, CA (US)

( * ) Notice: Subject to any disclaimer, the term of this patent is extended or adjusted under 35 U.S.C. 154(b) by 35 days.

This patent is subject to a terminal disclaimer.

(21) Appl. No.: 18/743,400

(22) Filed: Jun. 14, 2024

(65) Prior Publication Data

US 2025/0325867 A1 Oct. 23, 2025

Related U.S. Application Data

(63) Continuation of application No. 18/428,646, filed on Apr. 22, 2024.

(51) Int. Cl.
*A63B 23/04* (2006.01)
*A63B 21/00* (2006.01)
(Continued)

(52) U.S. Cl.
CPC ..... *A63B 23/0405* (2013.01); *A63B 21/0615* (2013.01); *A63B 21/4031* (2015.10);
(Continued)

(58) Field of Classification Search
CPC ..... A63B 23/0405; A63B 23/03525; A63B 23/03566; A63B 23/04; A63B 21/0615; A63B 21/4031; A63B 21/4034; A63B 21/4045; A63B 21/062; A63B 21/0622; A63B 21/40; A63B 21/4027;
(Continued)

(56) References Cited

U.S. PATENT DOCUMENTS 7,115,080 B2 * 10/2006 Cockrill, Jr. ..... A63B 21/0626 482/138
11,701,545 B2 * 7/2023 Meredith ..... A63B 21/0615 482/122
(Continued)

OTHER PUBLICATIONS

Syedee Compact Leg Sled (Leg Press) Machine, on sale at: https://www.amazon.com/syedee-Compact-Machine-Capacity-Hamstrings/dp/B0C4F2MR16.
(Continued)

*Primary Examiner* — Megan Anderson
*Assistant Examiner* — Kathleen M Fisk
(74) *Attorney, Agent, or Firm* — Sung Oh

(57) ABSTRACT

An exercise machine that combines the functionality of a leg press exercise machine with the functionality of a hip thrust exercise machine in a single machine. In an embodiment, the exercise machine comprises an adjustable exercise bed comprising an adjustable backrest and a lockable, pivoting seat; a weight plate holder; a footpad having different angles for leg presses and hip thrusts; and an incline adjustment mechanism. The exercise machine can be converted from a leg press machine to a hip thrust machine by changing the position and settings of the adjustable backrest and lockable, pivoting seat.

12 Claims, 10 Drawing Sheets

(51) Int. Cl.
*A63B 21/06* (2006.01)
*A63B 23/035* (2006.01)

(52) U.S. Cl.
CPC ..... *A63B 21/4034* (2015.10); *A63B 21/4045* (2015.10); *A63B 23/03525* (2013.01); *A63B 2023/0411* (2013.01); *A63B 2225/09* (2013.01)

(58) Field of Classification Search
CPC ..... A63B 21/4029; A63B 21/4033; A63B 21/4041; A63B 2023/0411; A63B 2225/09
See application file for complete search history.

(56) References Cited

U.S. PATENT DOCUMENTS

| | | | | |
|---|---|---|---|---|
| 12,390,680 | B1 * | 8/2025 | Nolan | A63B 21/4035 |
| 2003/0050157 | A1 * | 3/2003 | Teuscher | A63B 21/00 482/142 |

OTHER PUBLICATIONS

SFE Commercial Hip Thrust Glute Machine, on sale at: https://sportsandfitnessexchange.com/products/sfe-hip-thrust-glute-machine.

* cited by examiner

COMBINATION LEG PRESS AND HIP THRUST EXERCISE MACHINE

CROSS-REFERENCE TO RELATED APPLICATIONS

Priority is claimed in the application data sheet to the following patents or patent applications, each of which is expressly incorporated herein by reference in its entirety:

Ser. No. 18/428,646

BACKGROUND

Field of the Art

The present invention is in the field of fitness and exercise, and more particularly to fitness machines for multiple types of exercise.

Discussion of the State of the Art

Single-purpose exercise machines require a considerable amount of floor space, whether in a commercial gym or home gym. Smaller gyms are unable to provide floor space for a large range of single-purpose exercise machines, and must choose which machines to provide and which not to provide. Two popular single-purpose exercise machine are the leg press machine and the hip thrust machine. There is currently no exercise machine that combines both types of exercise in a single machine, thus saving floor space and allowing gyms to provide a larger range of available exercises.

What is needed is an exercise machine that combines the functionality of a leg press exercise machine with the functionality of a hip thrust exercise machine in a single machine.

SUMMARY

Accordingly, the inventor has conceived and reduced to practice, an exercise machine that combines the functionality of a leg press exercise machine with the functionality of a hip thrust exercise machine in a single machine. In an embodiment, the exercise machine comprises an adjustable exercise bed comprising an adjustable backrest and a lockable, pivoting seat; a weight plate holder; a footpad having different angles for leg presses and hip thrusts; and an incline adjustment mechanism. The exercise machine can be converted from a leg press machine to a hip thrust machine by changing the position and settings of the adjustable backrest and lockable, pivoting seat.

According to a preferred embodiment, a combination leg press and hip thrust exercise machine is disclosed, comprising: a frame comprising an inclined slide structure comprising a slide rail; an adjustable exercise bed comprising: a carriage comprising: a carriage frame configured to support an adjustable backrest and a pivoting, lockable seat; a pivot mechanism configured to allow pivoting of the adjustable backrest and pivoting, lockable seat; one or more bearings configured to allow the carriage to ride along the slide rail of the inclined slide structure; and a seat locking pin hole for locking of the pivoting, lockable seat; the adjustable backrest attached to the carriage at the pivot mechanism, the adjustable backrest comprising a back rest pad, an angle locking pin, and an angle adjustment bracket comprising one or more holes, wherein: insertion of the angle locking pin into a first hole of the one or more holes of the angle adjustment bracket causes the adjustable backrest to be placed into a raised position relative to the slide structure; and removal of the angle locking pin from the first hole of the angle adjustment bracket allows the adjustable backrest to be placed into a flat position relative to the slide structure; and the pivoting, lockable seat attached to the carriage at the pivot mechanism, the pivoting, lockable seat comprising a seat pad, a seat locking pin, and a hip attachment device, wherein: insertion of the seat locking pin into the seat locking pin hole of the carriage locks the pivoting, lockable seat into a flat position relative to the slide mechanism; and removal of the seat locking pin from the seat locking pin hole of the carriage allows the pivoting, lockable seat to be raised upward relative to the slide structure.

According to an aspect of an embodiment, an adjustable incline mechanism allows the incline of the slide structure to be changed.

According to an aspect of an embodiment, the slide structure has a plurality of slide rails.

According to an aspect of an embodiment, the inclined slide structure further comprises a slide locking pin and the adjustable backrest has a slide lock bracket comprising a slide lock hole wherein: insertion of the slide locking pin into the slide lock hole causes the adjustable exercise bed to be locked in a fixed position along the slide structure; and removal of the slide locking pin from the slide lock hole allows the adjustable exercise bed to move along the slide structure.

According to an aspect of an embodiment, the machine further comprises a footpad against which a user of the exercise machine may push during exercise.

According to an aspect of an embodiment, the footpad comprises an incline adjustment mechanism for changing an angle of the platform.

According to an aspect of an embodiment, the footpad comprises a dual-angled platform having a first portion of the platform at a flatter angle relative to the ground and a second portion of the platform at a steeper angle relative to the ground.

According to an aspect of an embodiment, the carriage further comprises weight plate holders for holding weight plates.

According to an aspect of an embodiment, the carriage has a plurality of bearings, wherein: at least a first bearing of the plurality of bearings rides on the underside of the slide rail; and at least a second bearing of the plurality of bearings rides on the top side of the slide rail.

According to an aspect of an embodiment, the slide structure has a plurality of rails; the carriage has plurality of bearings; at least a first set of bearings of the plurality of bearings rides on the underside of each of the plurality of rails; and at least a second set of bearings of the plurality of bearings rides on the top side of each of the plurality of rails.

According to an aspect of an embodiment, the pivot mechanism comprises a first pivot and a second pivot, wherein: the adjustable backrest is attached to, and pivots at, the first pivot; and the pivoting, lockable seat is attached to, and pivots at, the second pivot.

BRIEF DESCRIPTION OF THE DRAWING FIGURES

DETAILED DESCRIPTION

Figure 1:
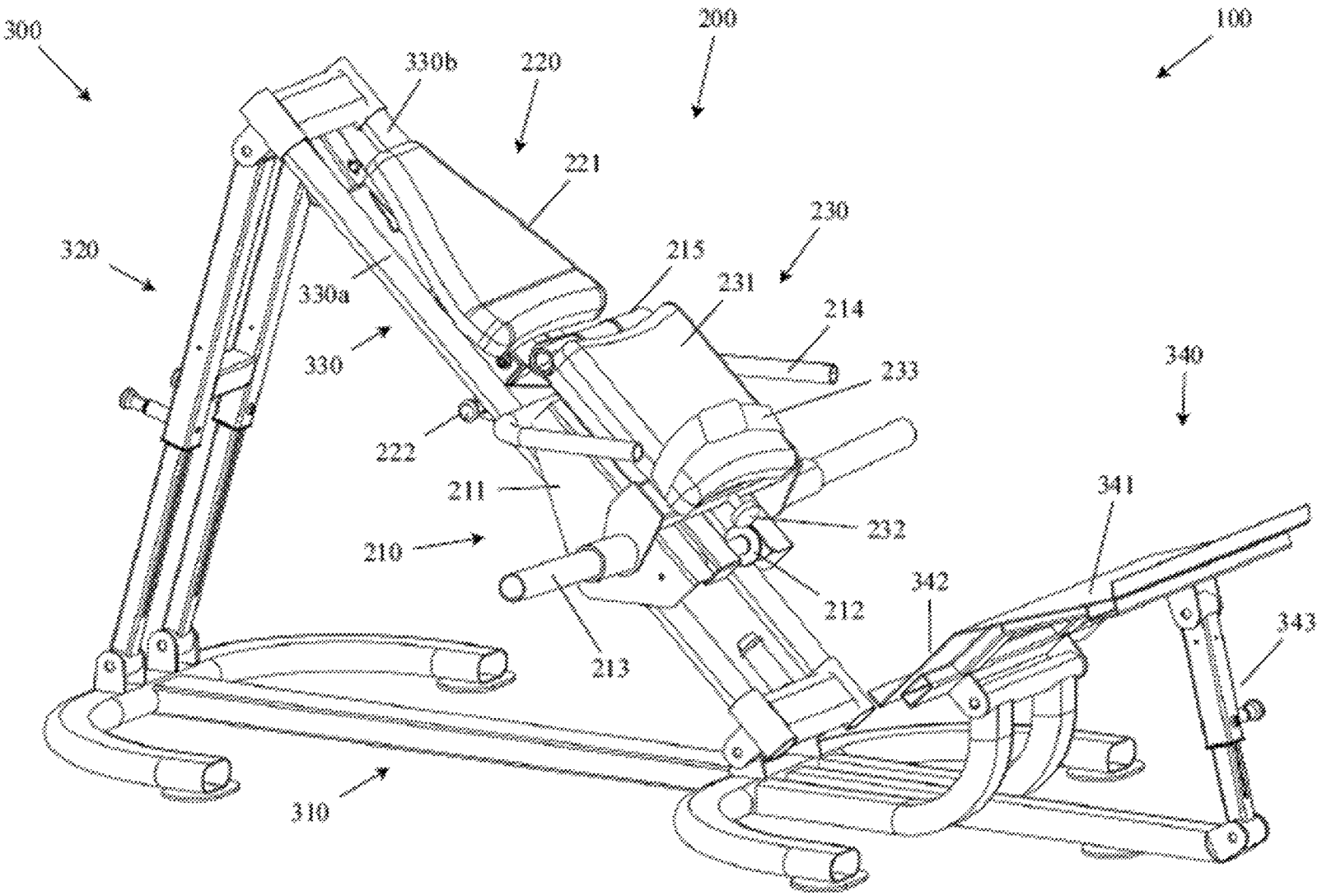
FIG. 1 is a front perspective view of an exemplary embodiment of a combined leg press/hip thrust exercise machine.

The inventor has conceived, and reduced to practice, an exercise machine that combines the functionality of a leg press exercise machine with the functionality of a hip thrust exercise machine in a single machine. In an embodiment, the exercise machine comprises an adjustable exercise bed comprising an adjustable backrest and a lockable, pivoting seat; a weight plate holder; a footpad having different angles for leg presses and hip thrusts; and an incline adjustment mechanism. The exercise machine can be converted from a leg press machine to a hip thrust machine by changing the position and settings of the adjustable backrest and lockable, pivoting seat.

Two popular single-purpose exercise machine are the incline leg press (also known as inclined squat) machine and the hip thrust (also known as the gluteus drive or glute drive machine). There is currently no exercise machine that combines both types of exercise in a single machine, thus saving floor space and allowing gyms to provide a larger range of available exercises.

The combination leg press and hip thrust exercise machine described herein solves this problem using an adjustable exercise bed that can be converted from a leg press configuration to a hip thrust configuration. In an embodiment, the adjustable exercise bed comprises an adjustable backrest, and a lockable, pivoting seat. The adjustable backrest can be placed in a raised position whereby it acts as a backrest or back support against which the user can push upward along the machine's incline for performing leg presses, and can be laid flat whereby it acts as an upper back support against which the user can push downward for performing hip thrusts. The lockable, pivoting seat can be locked in a flat position for use as a seat for performing leg presses, or can be unlocked, allowing the seat to pivot upwards for performing hip thrusts.

In some embodiments, the adjustable exercise bed further comprises an incline locking mechanism. The incline locking mechanism can be in a released or "free" position wherein the adjustable exercise bed is allowed to travel up and down the incline for performing leg presses, or can be in a fixed or locked position wherein the adjustable exercise bed is locked in a fixed position along the incline for performance of hip thrusts.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

DETAILED DESCRIPTION OF DRAWING FIGURES

FIG. 1 is a front perspective view of an exemplary embodiment of a combined leg press/hip thrust exercise machine. In this embodiment, the combined leg press/hip thrust exercise machine 100 comprises a frame 300 and an adjustable exercise bed 200 comprising a carriage 210, an adjustable backrest 220, and a lockable, pivoting seat 230.

During use as a leg press machine, the adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

During use as a hip thrust machine, the adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used including, but not limited to, belts, straps, ropes, and cables. The belt may be adjustable to tighten and loosen the seat 230 to the user's hips, and may have a buckle or other attachment and release device. In some embodiments, a non-flexible but adjustable bar, rod, or metal strap may be used. The adjustable exercise bed 200 is held by the user in a relatively stable position along the axis of the slide structure 330 and can optionally be locked in a fixed position along the axis of the slide structure 330 by placing the slide lock pin 331 (shown in later drawings) into the slide lock bracket 225 comprising a slide lock hole (shown in later drawings) of the adjustable backrest 220.

The frame 300 comprises a base 310 on which the machine rests and to which other components of the machine are attached, an adjustable incline mechanism 320 which allows adjustment of the incline of the adjustable exercise bed 200 to increase or decrease the difficulty of exercise movements, a slide structure 330, and a footpad 340. In this embodiment, the adjustable incline mechanism 320 comprises a pair of telescoping arms with pins for locking the telescoping arms to a particular length, but other mechanisms for adjusting the incline could be used. The slide structure 330 of this embodiment comprises a pair of tubular slide rails 330*a*, 330*b* parallel to one another on which the carriage 210 of the adjustable exercise bed 200 is mounted. However, the slide structure 330 is not limited to this configuration. Other configurations may include a single slide rail, more than two slide rails, and different cross-sections such square rails, rectangular rails, triangular rails, etc. The footpad 340 comprises a dual-angled platform having a first portion of the platform 341 at a flatter angle relative to the ground (i.e., facing somewhat upward relative to the adjustable exercise bed 200) appropriate for performing hip thrusts and a second portion of the platform 342 at a steeper angle relative to the ground (i.e., roughly facing toward the adjustable exercise bed 200) appropriate for performing leg presses. The footpad 340 also comprises an incline adjustment mechanism 343 for changing the angle of the platform (and the corresponding angles of the first 341 and second 342 portions of the platform) to allow users to individualize their foot angles for better comfort and or to emphasize exercise of certain portions of the muscle groups for each exercise.

The adjustable exercise bed 200 of this embodiment comprises a carriage (or sled) 210, an adjustable backrest 220, and a lockable, pivoting seat 230.

The carriage 210 supports the adjustable exercise bed 200 on the slide structure 330 and allows the adjustable exercise bed 200 to ride up and down along the slide structure 330 for leg press exercises. The carriage 210 comprises a carriage frame 211, a plurality of bearings 212 which allow the carriage to ride along the slide structure 330, a pair of weight plate holders 213 (one on each side of the carriage 210) for holding weight plates for increasing the amount of weight lifted during exercise, a pair of handles 214 for the user to hold for stability during exercise, a pivot mechanism 215 for pivoting of both the adjustable backrest 220 and the lockable, pivoting seat 230 as appropriate for the exercise chosen, and a slide locking pin 331 (shown in later drawings) for optionally locking the adjustable bed rest 200 in place on the slide structure 330 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot).

The adjustable backrest 220 comprises a back rest pad 221, an angle locking pin 222, an angle adjustment bracket 223 (shown in later drawings), a backrest support arm 224 (shown in later drawings), and a slide lock bracket 225 comprising a slide lock hole. The backrest pad 221 is for supporting the back of the user. It is laid flat during hip thrust exercises and raised up during leg press exercises. For comfort, it is ideally made from a deformable material such as foam with a wear-resistant covering, although rigid materials formed to fit a user's upper back may be used (e.g., shaped aluminum, shaped wood). The locking pin 222 is used to select the position of the adjustable backrest 220 and lock it into position during exercise. The angle locking pin 222 fits into one or more pin holes on the angle adjustment bracket. The backrest support arm provides support for the adjustable backrest 220 and provides a mounting location for the angle adjustment bracket. The backrest support arm is attached to the pivot mechanism 215 (in this embodiment by a single attachment in the center of the pivot mechanism) which provides the pivot point for adjusting the angle of the adjustable backrest 220. In this embodiment, the backrest support arm is attached to the pivot point with an offset, allowing the backrest pad 221 to remain flush with, or below, the plane of the seat pad 231 when laid flat. For hip thrust exercises, the adjustable exercise bed 200 may be placed in a fixed position along the slide structure 330 by placing the slide lock pin 331 (shown in later drawings) into the slide lock bracket (shown in later drawings).

The pivoting, lockable seat 230 comprises a seat pad 231, a seat locking pin 232, and a seat support arm 234 (shown in later drawings). The seat pad 231 is for supporting the lower back and buttocks of the user. It is locked in a flat position during leg press exercise, where it acts as a seat. It is released and allowed to pivot at the location of the pivot mechanism 215 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). For comfort, it is ideally made from a deformable material such as foam with a wear-resistant covering, although rigid materials formed to fit a user's upper back may be used (e.g., shaped aluminum, shaped wood). The seat locking pin 232 is used to lock and unlock the pivoting, lockable seat 230. The locking pin 222 fits into a pin hole on the carriage 210. The seat support arm provides support for pivoting, lockable seat 230. The seat support arm is attached to the pivot mechanism 215 (in this embodiment by a dual attachment in the outer ends of the pivot mechanism) which provides the pivot point for pivoting the seat 230 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. In this embodiment, the seat support arm is attached to the pivot point without an offset.

Figure 2:
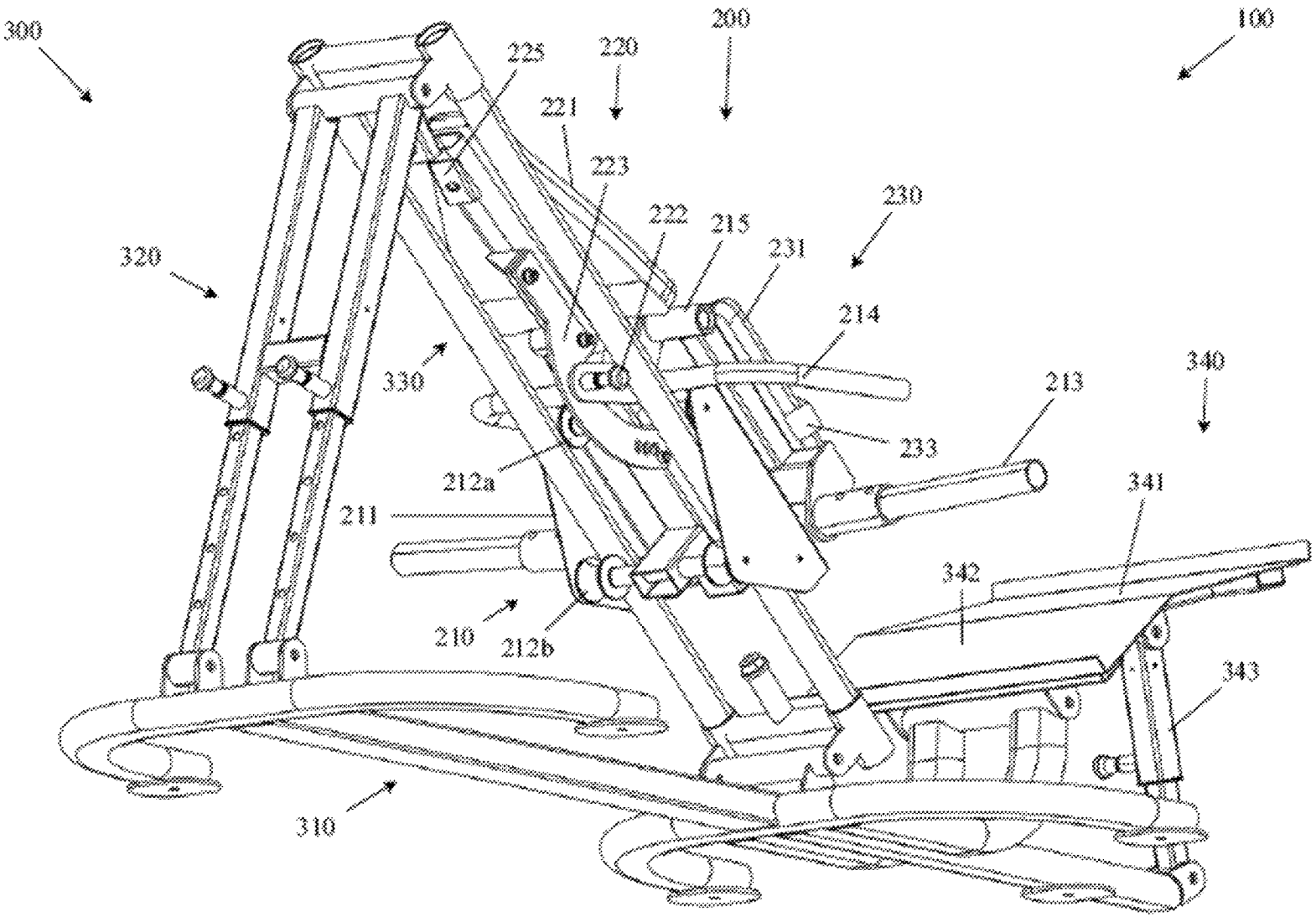
FIG. 2 is a rear perspective view of an exemplary embodiment of a combined leg press/hip thrust exercise machine.

FIG. 2 is a rear perspective view of an exemplary embodiment of a combined leg press/hip thrust exercise machine. In this embodiment, the combined leg press/hip thrust exercise machine 100 comprises a frame 300 and an adjustable exercise bed 200 comprising a carriage 210, an adjustable backrest 220, and a lockable, pivoting seat 230.

During use as a leg press machine, the adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

During use as a hip thrust machine, the adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. The adjustable exercise bed 200 is held by the user in a relatively stable position along the axis of the slide structure 330 and can optionally be locked in a fixed position along the axis of the slide structure 330 by placing the slide lock pin 331 (shown in later drawings) into the slide lock bracket 225 comprising a slide lock hole of the adjustable backrest 220.

The frame 300 comprises a base 310 on which the machine rests and to which other components of the machine are attached, an adjustable incline mechanism 320 which allows adjustment of the incline of the adjustable exercise bed 200 to increase or decrease the difficulty of exercise movements, a slide structure 330, and a footpad 340. In this embodiment, the adjustable incline mechanism 320 comprises a pair of telescoping arms with pins for locking the telescoping arms to a particular length, but other mechanisms for adjusting the incline could be used. The slide structure 330 of this embodiment comprises a pair of tubular slide rails 330*a*, 330*b* parallel to one another on which the carriage 210 of the adjustable exercise bed 200 is mounted. However, the slide structure 330 is not limited to this configuration. Other configurations may include a single slide rail, more than two slide rails, and different cross-sections such square rails, rectangular rails, triangular rails, etc. The footpad 340 comprises a dual-angled platform having a first portion of the platform 341 at a flatter angle relative to the ground (i.e., facing somewhat upward relative to the adjustable exercise bed 200) appropriate for performing hip thrusts and a second portion of the platform 342 at a steeper angle relative to the ground (i.e., roughly facing toward the adjustable exercise bed 200) appropriate for performing leg presses. The footpad 340 also comprises an incline adjustment mechanism 343 for changing the angle of the platform (and the corresponding angles of the first 341 and second 342 portions of the platform) to allow users to individualize their foot angles for better comfort and or to emphasize exercise of certain portions of the muscle groups for each exercise.

The adjustable exercise bed 200 of this embodiment comprises a carriage (or sled) 210, an adjustable backrest 220, and a lockable, pivoting seat 230.

The carriage 210 supports the adjustable exercise bed 200 on the slide structure 330 and allows the adjustable exercise bed 200 to ride up and down along the slide structure 330 for leg press exercises. The carriage 210 comprises a carriage frame 211, a plurality of bearings 212 (visible in this drawing as wheels on opposing sides of each slide rail to keep the carriage from lifting off the slide structure, with wheels 212*a* on the upper side of each slide structure and wheels 212*b* on the lower side of each slide structure) which allow the carriage to ride along the slide structure 330, a pair of weight plate holders 213 (one on each side of the carriage 210) for holding weight plates for increasing the amount of weight lifted during exercise, a pair of handles 214 for the user to hold for stability during exercise, a pivot mechanism 215 for pivoting of both the adjustable backrest 220 and the lockable, pivoting seat 230 as appropriate for the exercise chosen, and a slide locking pin 331 (shown in later drawings) for optionally locking the adjustable bed rest 200 in place on the slide structure 330 during hip thrust exercises.

The adjustable backrest 220 comprises a back rest pad 221, an angle locking pin 222, an angle adjustment bracket 223, a backrest support arm 224 (shown in later drawings), and a slide lock bracket 225 comprising a slide lock hole. The backrest pad 221 is for supporting the back of the user. It is laid flat during hip thrust exercises and raised up during leg press exercises. For comfort, it is ideally made from a deformable material such as foam with a wear-resistant covering, although rigid materials formed to fit a user's upper back may be used (e.g., shaped aluminum, shaped wood). The locking pin 222 is used to select the position of the adjustable backrest 220 and lock it into position during exercise. The angle locking pin 222 fits into one or more pin holes on the angle adjustment bracket. The backrest support arm provides support for the adjustable backrest 220 and provides a mounting location for the angle adjustment bracket. The backrest support arm is attached to the pivot mechanism 215 (in this embodiment by a single attachment in the center of the pivot mechanism) which provides the pivot point for adjusting the angle of the adjustable backrest 220. In this embodiment, the backrest support arm is attached to the pivot point with an offset, allowing the backrest pad 221 to remain flush with, or below, the plane of the seat pad 231 when laid flat. For hip thrust exercises, the adjustable exercise bed 200 may be placed in a fixed position along the slide structure 330 by placing the slide lock pin 331 (shown in later drawings) into the slide lock bracket 225 comprising a slide lock hole.

The pivoting, lockable seat 230 comprises a seat pad 231, a seat locking pin 232, and a seat support arm 234 (shown in later drawings). The seat pad 231 is for supporting the lower back and buttocks of the user. It is locked in a flat position during leg press exercise, where it acts as a seat. It is released and allowed to pivot at the location of the pivot mechanism 215 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). For comfort, it is ideally made from a deformable material such as foam with a wear-resistant covering, although rigid materials formed to fit a user's upper back may be used (e.g., shaped aluminum, shaped wood). The seat locking pin 232 is used to lock and unlock the pivoting, lockable seat 230. The locking pin 222 fits into a pin hole on the carriage 210. The seat support arm 234 (shown in later drawings) provides support for pivoting, lockable seat 230. The seat support arm is attached to the pivot mechanism 215 (in this embodiment by a dual attachment in the outer ends of the pivot mechanism) which provides the pivot point for pivoting the seat 230 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. In this embodiment, the seat support arm is attached to the pivot point without an offset.

Figure 3:
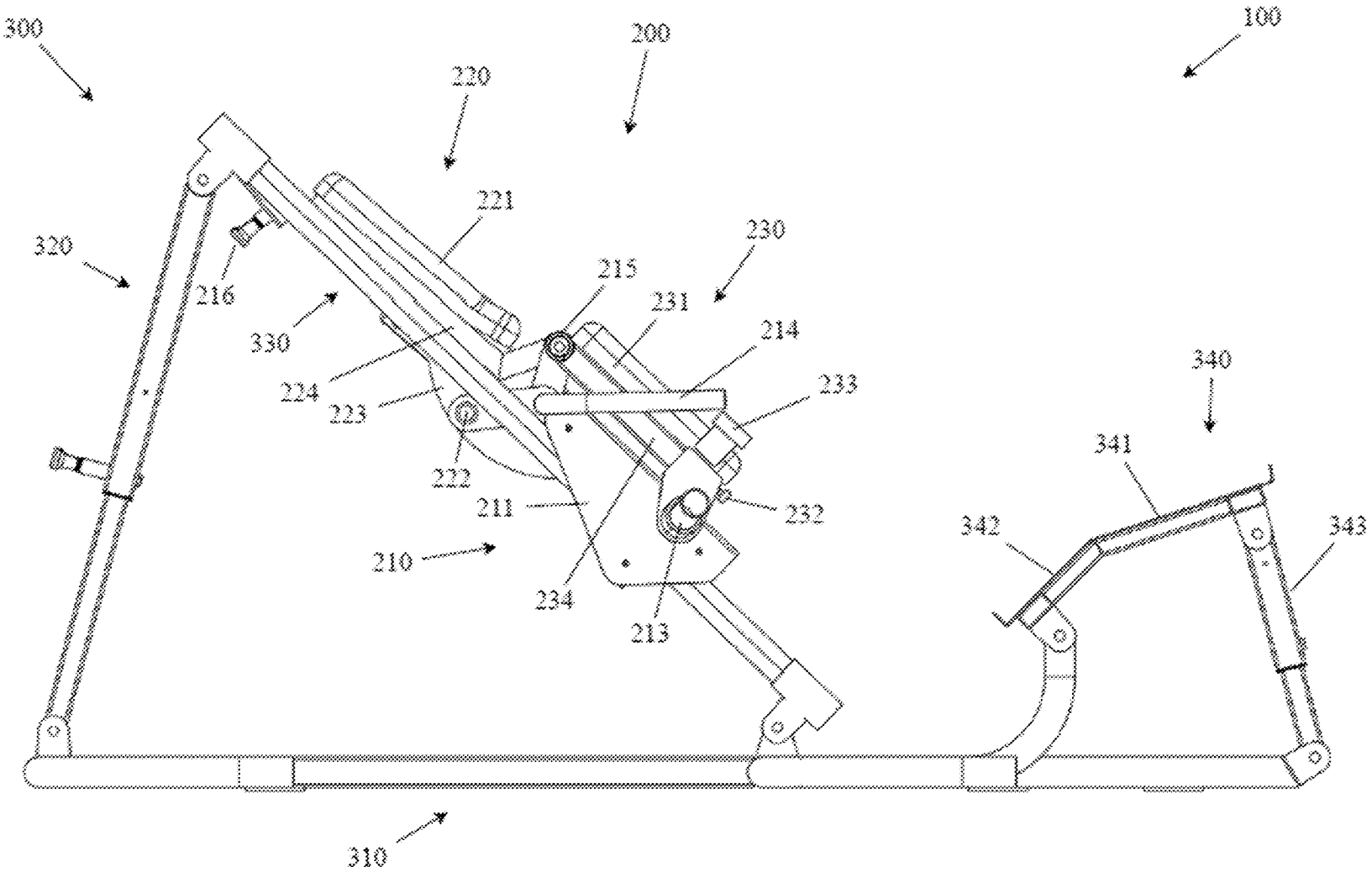
FIG. 3 is a side view of an exemplary embodiment of a combined leg press/hip thrust exercise machine.

FIG. 3 is a side view of an exemplary embodiment of a combined leg press/hip thrust exercise machine. In this embodiment, the combined leg press/hip thrust exercise machine 100 comprises a frame 300 and an adjustable exercise bed 200 comprising a carriage 210, an adjustable backrest 220, and a lockable, pivoting seat 230.

During use as a leg press machine, the adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

During use as a hip thrust machine, the adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. The adjustable exercise bed 200 is held by the user in a relatively stable position along the axis of the slide structure 330 and can optionally be locked in a fixed position along the axis of the slide structure 330 by placing the slide lock pin 331 into the slide lock bracket 225 comprising a slide lock hole of the adjustable backrest 220.

The frame 300 comprises a base 310 on which the machine rests and to which other components of the machine are attached, an adjustable incline mechanism 320 which allows adjustment of the incline of the adjustable exercise bed 200 to increase or decrease the difficulty of exercise movements, a slide structure 330, and a footpad 340. In this embodiment, the adjustable incline mechanism 320 comprises a pair of telescoping arms with pins for locking the telescoping arms to a particular length, but other mechanisms for adjusting the incline could be used. The slide structure 330 of this embodiment comprises a pair of tubular slide rails 330*a*, 330*b* parallel to one another on which the carriage 210 of the adjustable exercise bed 200 is mounted. However, the slide structure 330 is not limited to this configuration. Other configurations may include a single slide rail, more than two slide rails, and different cross-sections such square rails, rectangular rails, triangular rails, etc. The footpad 340 comprises a dual-angled platform having a first portion of the platform 341 at a flatter angle relative to the ground (i.e., facing somewhat upward relative to the adjustable exercise bed 200) appropriate for performing hip thrusts and a second portion of the platform 342 at a steeper angle relative to the ground (i.e., roughly facing toward the adjustable exercise bed 200) appropriate for performing leg presses. The footpad 340 also comprises an incline adjustment mechanism 343 for changing the angle of the platform (and the corresponding angles of the first 341 and second 342 portions of the platform) to allow users to individualize their foot angles for better comfort and or to emphasize exercise of certain portions of the muscle groups for each exercise.

The adjustable exercise bed 200 of this embodiment comprises a carriage (or sled) 210, an adjustable backrest 220, and a lockable, pivoting seat 230.

The carriage 210 supports the adjustable exercise bed 200 on the slide structure 330 and allows the adjustable exercise bed 200 to ride up and down along the slide structure 330 for leg press exercises. The carriage 210 comprises a carriage frame 211, a plurality of bearings 212 which allow the carriage to ride along the slide structure 330, a pair of weight plate holders 213 (one on each side of the carriage 210) for holding weight plates for increasing the amount of weight lifted during exercise, a pair of handles 214 for the user to hold for stability during exercise, a pivot mechanism 215 for pivoting of both the adjustable backrest 220 and the lockable, pivoting seat 230 as appropriate for the exercise chosen, and a slide locking pin 331 for optionally locking the adjustable bed rest 200 in place on the slide structure 330 during hip thrust exercises.

The adjustable backrest 220 comprises a back rest pad 221, an angle locking pin 222, an angle adjustment bracket 223, a backrest support arm 224, and a slide lock bracket 225 comprising a slide lock hole. The backrest pad 221 is for supporting the back of the user. It is laid flat during hip thrust exercises and raised up during leg press exercises. For comfort, it is ideally made from a deformable material such as foam with a wear-resistant covering, although rigid materials formed to fit a user's upper back may be used (e.g., shaped aluminum, shaped wood). The locking pin 222 is used to select the position of the adjustable backrest 220 and lock it into position during exercise. The angle locking pin 222 fits into one or more pin holes on the angle adjustment bracket. The backrest support arm provides support for the adjustable backrest 220 and provides a mounting location for the angle adjustment bracket. The backrest support arm is attached to the pivot mechanism 215 (in this embodiment by a single attachment in the center of the pivot mechanism) which provides the pivot point for adjusting the angle of the adjustable backrest 220. In this embodiment, the backrest support arm is attached to the pivot point with an offset, allowing the backrest pad 221 to remain flush with, or below, the plane of the seat pad 231 when laid flat. For hip thrust exercises, the adjustable exercise bed 200 may be placed in a fixed position along the slide structure 330 by placing the slide lock pin 331 into the slide lock bracket 225 comprising a slide lock hole.

The pivoting, lockable seat 230 comprises a seat pad 231, a seat locking pin 232, and a seat support arm 234. The seat pad 231 is for supporting the lower back and buttocks of the user. It is locked in a flat position during leg press exercise, where it acts as a seat. It is released and allowed to pivot at the location of the pivot mechanism 215 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). For comfort, it is ideally made from a deformable material such as foam with a wear-resistant covering, although rigid materials formed to fit a user's upper back may be used (e.g., shaped aluminum, shaped wood). The seat locking pin 232 is used to lock and unlock the pivoting, lockable seat 230. The locking pin 222 fits into a pin hole on the carriage 210. The seat support arm 234 provides support for pivoting, lockable seat 230. The seat support arm is attached to the pivot mechanism 215 (in this embodiment by a dual attachment in the outer ends of the pivot mechanism) which provides the pivot point for pivoting the seat 230 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. In this embodiment, the seat support arm is attached to the pivot point without an offset.

Figure 4:
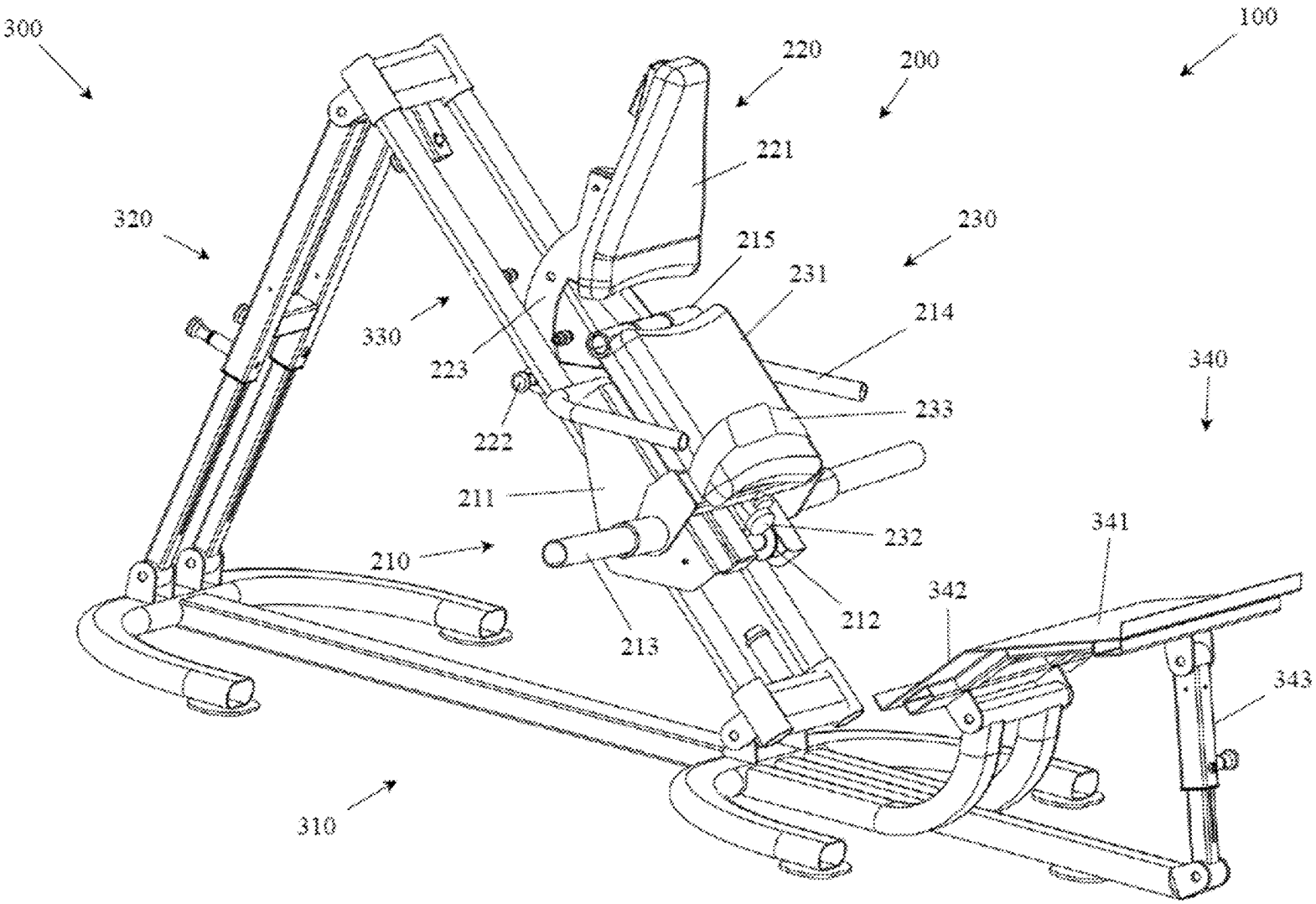
FIG. 4 is a front perspective view of an exemplary embodiment of a combined leg press/hip thrust exercise machine showing the machine configured for leg press exercise.

FIG. 4 is a front perspective view of an exemplary embodiment of a combined leg press/hip thrust exercise machine showing the machine configured for leg press exercise. Here, the adjustable exercise bed 200 is shown in its leg press configuration. The adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

In this embodiment, the combined leg press/hip thrust exercise machine 100 comprises a frame 300 and an adjustable exercise bed 200 comprising a carriage 210, an adjustable backrest 220, and a lockable, pivoting seat 230.

During use as a leg press machine, the adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

During use as a hip thrust machine, the adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. The adjustable exercise bed 200 is held by the user in a relatively stable position along the axis of the slide structure 330 and can optionally be locked in a fixed position along the axis of the slide structure 330 by placing the slide lock pin 331 into the slide lock bracket 225 comprising a slide lock hole of the adjustable backrest 220.

The frame 300 comprises a base 310 on which the machine rests and to which other components of the machine are attached, an adjustable incline mechanism 320 which allows adjustment of the incline of the adjustable exercise bed 200 to increase or decrease the difficulty of exercise movements, a slide structure 330, and a footpad 340. In this embodiment, the adjustable incline mechanism 320 comprises a pair of telescoping arms with pins for locking the telescoping arms to a particular length, but other mechanisms for adjusting the incline could be used. The slide structure 330 of this embodiment comprises a pair of tubular slide rails **330*a*, 330*b* a pair of tubular rails parallel to one another on which the carriage 210 of the adjustable exercise bed 200 is mounted. However, the slide structure 330 is not limited to this configuration. Other configurations may include a single slide rail, more than two slide rails, and different cross-sections such square rails, rectangular rails, triangular rails, etc. The footpad 340 comprises a dual-angled platform having a first portion of the platform 341 at a flatter angle relative to the ground (i.e., facing somewhat upward relative to the adjustable exercise bed 200) appropriate for performing hip thrusts and a second portion of the platform 342 at a steeper angle relative to the ground (i.e., roughly facing toward the adjustable exercise bed 200) appropriate for performing leg presses. The footpad 340 also comprises an incline adjustment mechanism 343 for changing the angle of the platform (and the corresponding angles of the first 341 and second 342** portions of the platform) to allow users to individualize their foot angles for better comfort and or to emphasize exercise of certain portions of the muscle groups for each exercise.

The adjustable exercise bed 200 of this embodiment comprises a carriage (or sled) 210, an adjustable backrest 220, and a lockable, pivoting seat 230.

The carriage 210 supports the adjustable exercise bed 200 on the slide structure 330 and allows the adjustable exercise bed 200 to ride up and down along the slide structure 330 for leg press exercises. The carriage 210 comprises a carriage frame 211, a plurality of bearings 212 which allow the carriage to ride along the slide structure 330, a pair of weight plate holders 213 (one on each side of the carriage 210) for holding weight plates for increasing the amount of weight lifted during exercise, a pair of handles 214 for the user to hold for stability during exercise, a pivot mechanism 215 for pivoting of both the adjustable backrest 220 and the lockable, pivoting seat 230 as appropriate for the exercise chosen, and a slide locking pin 331 for optionally locking the adjustable bed rest 200 in place on the slide structure 330 during hip thrust exercises.

The adjustable backrest 220 comprises a back rest pad 221, an angle locking pin 222, an angle adjustment bracket 223, a backrest support arm 224, and a slide lock bracket 225 comprising a slide lock hole. The backrest pad 221 is for supporting the back of the user. It is laid flat during hip thrust exercises and raised up during leg press exercises. For comfort, it is ideally made from a deformable material such as foam with a wear-resistant covering, although rigid materials formed to fit a user's upper back may be used (e.g., shaped aluminum, shaped wood). The locking pin 222 is used to select the position of the adjustable backrest 220 and lock it into position during exercise. The angle locking pin 222 fits into one or more pin holes on the angle adjustment bracket. The backrest support arm provides support for the adjustable backrest 220 and provides a mounting location for the angle adjustment bracket. The backrest support arm is attached to the pivot mechanism 215 (in this embodiment by a single attachment in the center of the pivot mechanism) which provides the pivot point for adjusting the angle of the adjustable backrest 220. In this embodiment, the backrest support arm is attached to the pivot point with an offset, allowing the backrest pad 221 to remain flush with, or below, the plane of the seat pad 231 when laid flat. For hip thrust exercises, the adjustable exercise bed 200 may be placed in a fixed position along the slide structure 330 by placing the slide lock pin 331 into the slide lock bracket 225 comprising a slide lock hole.

The pivoting, lockable seat 230 comprises a seat pad 231, a seat locking pin 232, and a seat support arm 234. The seat pad 231 is for supporting the lower back and buttocks of the user. It is locked in a flat position during leg press exercise, where it acts as a seat. It is released and allowed to pivot at the location of the pivot mechanism 215 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). For comfort, it is ideally made from a deformable material such as foam with a wear-resistant covering, although rigid materials formed to fit a user's upper back may be used (e.g., shaped aluminum, shaped wood). The seat locking pin 232 is used to lock and unlock the pivoting, lockable seat 230. The locking pin 222 fits into a pin hole on the carriage 210. The seat support arm 234 provides support for pivoting, lockable seat 230. The seat support arm is attached to the pivot mechanism 215 (in this embodiment by a dual attachment in the outer ends of the pivot mechanism) which provides the pivot point for pivoting the seat 230 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. In this embodiment, the seat support arm is attached to the pivot point without an offset.

Figure 5:
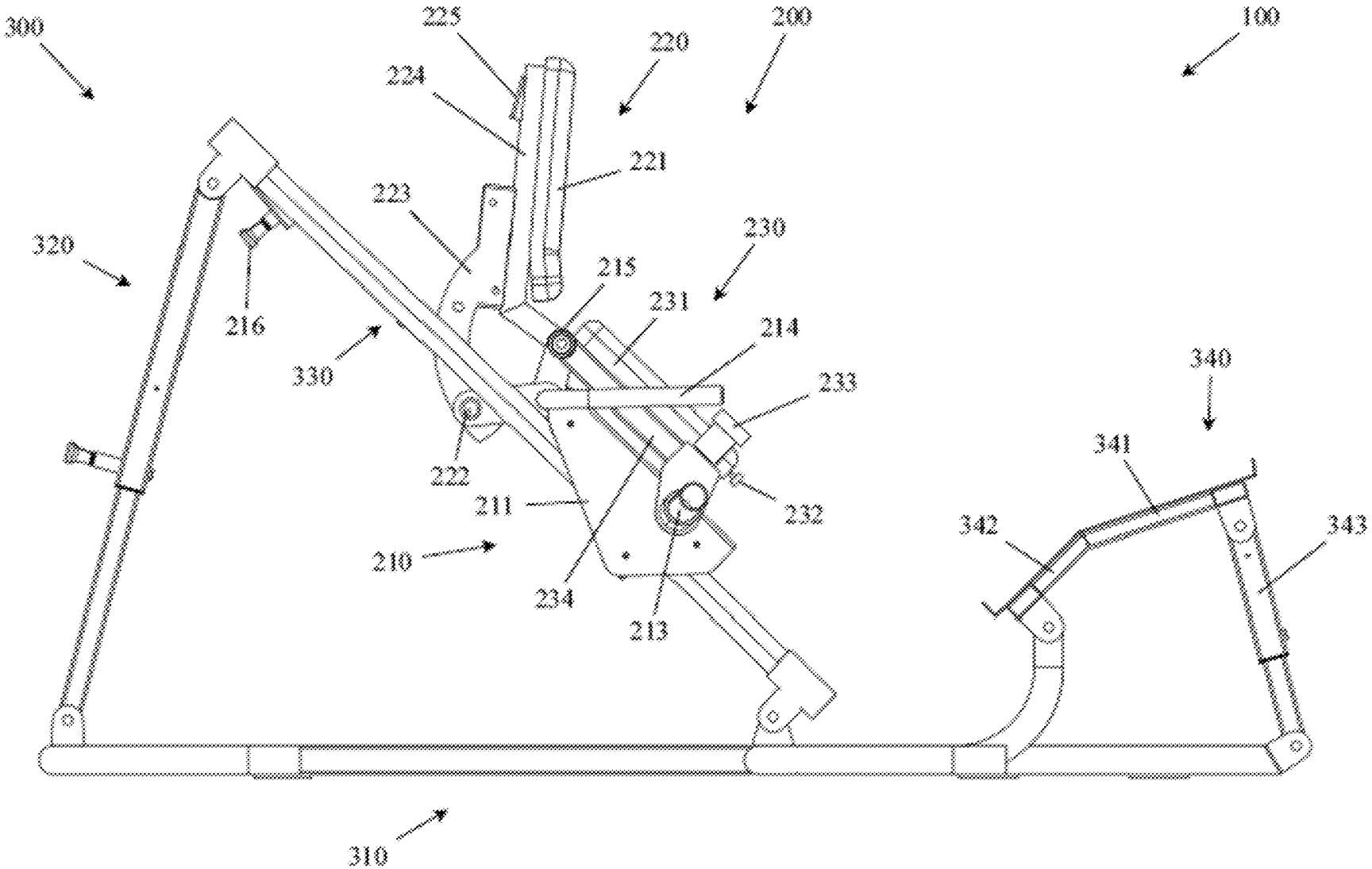
FIG. 5 is a side view of an exemplary embodiment of a combined leg press/hip thrust exercise machine showing the machine configured for leg press exercise.

FIG. 5 is a side view of an exemplary embodiment of a combined leg press/hip thrust exercise machine showing the machine configured for leg press exercise. This is a side view of the same configuration as in FIG. 4.

Figure 6:
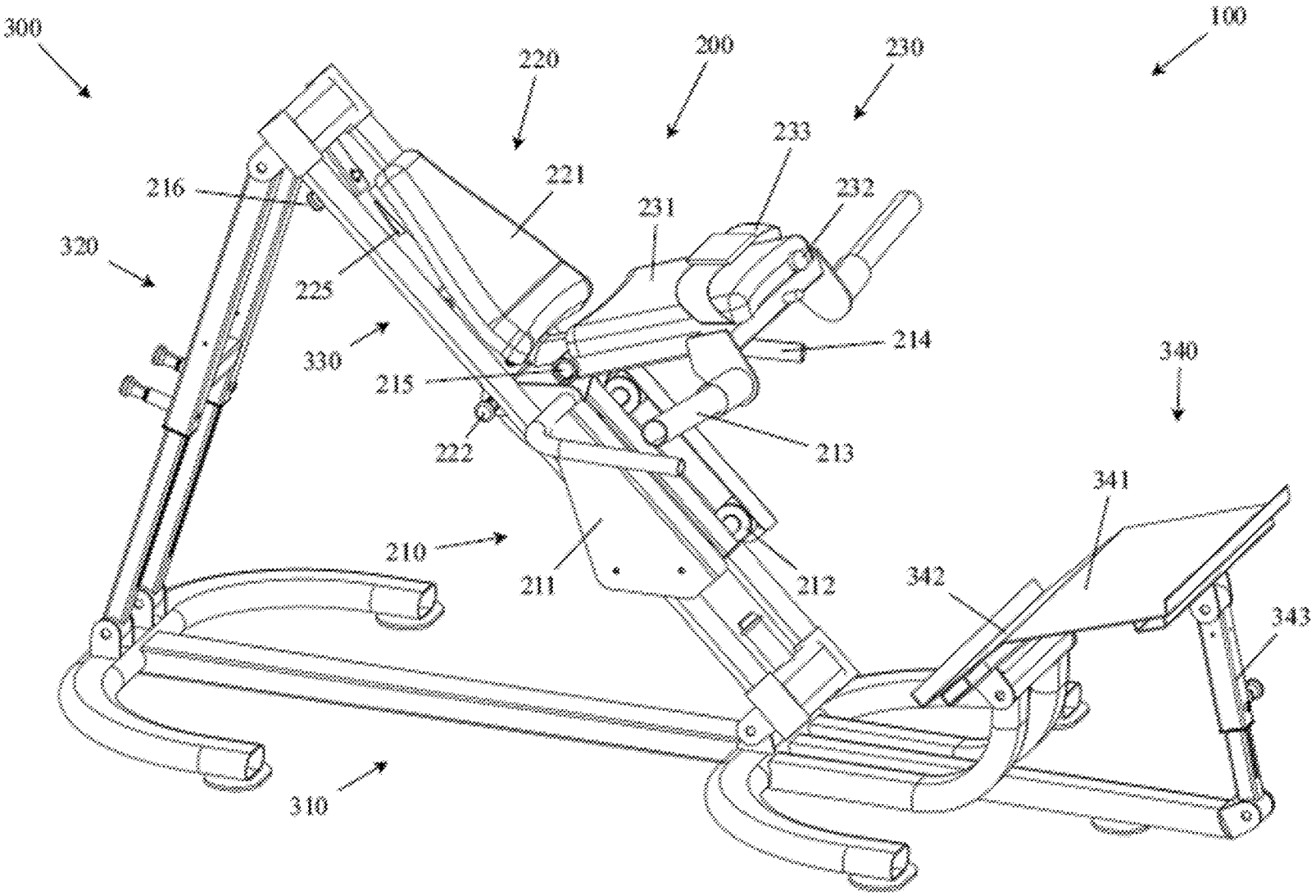
FIG. 6 is a front perspective view of an exemplary embodiment of a combined leg press/hip thrust exercise machine showing the machine configured for hip thrust exercise.

FIG. 6 is a front perspective view of an exemplary embodiment of a combined leg press/hip thrust exercise machine showing the machine configured for hip thrust exercise. Here, the adjustable exercise bed 200 is shown in its hip thrust configuration. The adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. The adjustable exercise bed 200 is held by the user in a relatively stable position along the axis of the slide structure 330 and can optionally be locked in a fixed position along the axis of the slide structure 330 by placing the slide lock pin 331 into the slide lock bracket 225 comprising a slide lock hole of the adjustable backrest 220.

In this embodiment, the combined leg press/hip thrust exercise machine 100 comprises a frame 300 and an adjustable exercise bed 200 comprising a carriage 210, an adjustable backrest 220, and a lockable, pivoting seat 230.

During use as a leg press machine, the adjustable backrest 220 is placed into a raised position to act as a back support for the upper back against which the user can push upward and the pivoting, lockable seat 230 is locked in a flat position to act as a seat for the user. The user pushes the adjustable exercise bed 200 upward along the axis of the slide structure 330, preferably with the user's feet placed against the second portion 342 of the footpad 340.

During use as a hip thrust machine, the adjustable backrest 220 is placed into a flat position to act as a back support for the upper back against which the user can push downward and the pivoting, lockable seat 230 is released so that the user can perform hip thrusts upward relative to the ground, preferably with the user's feet placed against the first portion 341 of the footpad 340. A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. The adjustable exercise bed 200 is held by the user in a relatively stable position along the axis of the slide structure 330 and can optionally be locked in a fixed position along the axis of the slide structure 330 by placing the slide lock pin 331 into the slide lock bracket 225 comprising a slide lock hole of the adjustable backrest 220.

The frame 300 comprises a base 310 on which the machine rests and to which other components of the machine are attached, an adjustable incline mechanism 320 which allows adjustment of the incline of the adjustable exercise bed 200 to increase or decrease the difficulty of exercise movements, a slide structure 330, and a footpad 340. In this embodiment, the adjustable incline mechanism 320 comprises a pair of telescoping arms with pins for locking the telescoping arms to a particular length, but other mechanisms for adjusting the incline could be used. The slide structure 330 of this embodiment comprises a pair of tubular slide rails 330*a*, 330*b* parallel to one another on which the carriage 210 of the adjustable exercise bed 200 is mounted. However, the slide structure 330 is not limited to this configuration. Other configurations may include a single slide rail, more than two slide rails, and different cross-sections such square rails, rectangular rails, triangular rails, etc. The footpad 340 comprises a dual-angled platform having a first portion of the platform 341 at a flatter angle relative to the ground (i.e., facing somewhat upward relative to the adjustable exercise bed 200) appropriate for performing hip thrusts and a second portion of the platform 342 at a steeper angle relative to the ground (i.e., roughly facing toward the adjustable exercise bed 200) appropriate for performing leg presses. The footpad 340 also comprises an incline adjustment mechanism 343 for changing the angle of the platform (and the corresponding angles of the first 341 and second 342 portions of the platform) to allow users to individualize their foot angles for better comfort and or to emphasize exercise of certain portions of the muscle groups for each exercise.

The adjustable exercise bed 200 of this embodiment comprises a carriage (or sled) 210, an adjustable backrest 220, and a lockable, pivoting seat 230.

The carriage 210 supports the adjustable exercise bed 200 on the slide structure 330 and allows the adjustable exercise bed 200 to ride up and down along the slide structure 330 for leg press exercises. The carriage 210 comprises a carriage frame 211, a plurality of bearings 212 which allow the carriage to ride along the slide structure 330, a pair of weight plate holders 213 (one on each side of the carriage 210) for holding weight plates for increasing the amount of weight lifted during exercise, a pair of handles 214 for the user to hold for stability during exercise, a pivot mechanism 215 for pivoting of both the adjustable backrest 220 and the lockable, pivoting seat 230 as appropriate for the exercise chosen, and a slide locking pin 331 for optionally locking the adjustable bed rest 200 in place on the slide structure 330 during hip thrust exercises.

The adjustable backrest 220 comprises a back rest pad 221, an angle locking pin 222, an angle adjustment bracket 223, a backrest support arm 224, and a slide lock bracket 225 comprising a slide lock hole. The backrest pad 221 is for supporting the back of the user. It is laid flat during hip thrust exercises and raised up during leg press exercises. For comfort, it is ideally made from a deformable material such as foam with a wear-resistant covering, although rigid materials formed to fit a user's upper back may be used (e.g., shaped aluminum, shaped wood). The locking pin 222 is used to select the position of the adjustable backrest 220 and lock it into position during exercise. The angle locking pin 222 fits into one or more pin holes on the angle adjustment bracket. The backrest support arm provides support for the adjustable backrest 220 and provides a mounting location for the angle adjustment bracket. The backrest support arm is attached to the pivot mechanism 215 (in this embodiment by a single attachment in the center of the pivot mechanism) which provides the pivot point for adjusting the angle of the adjustable backrest 220. In this embodiment, the backrest support arm is attached to the pivot point with an offset, allowing the backrest pad 221 to remain flush with, or below, the plane of the seat pad 231 when laid flat. For hip thrust exercises, the adjustable exercise bed 200 may be placed in a fixed position along the slide structure 330 by placing the slide lock pin 331 into the slide lock bracket 225 comprising a slide lock hole.

The pivoting, lockable seat 230 comprises a seat pad 231, a seat locking pin 232, and a seat support arm 234. The seat pad 231 is for supporting the lower back and buttocks of the user. It is locked in a flat position during leg press exercise, where it acts as a seat. It is released and allowed to pivot at the location of the pivot mechanism 215 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). For comfort, it is ideally made from a deformable material such as foam with a wear-resistant covering, although rigid materials formed to fit a user's upper back may be used (e.g., shaped aluminum, shaped wood). The seat locking pin 232 is used to lock and unlock the pivoting, lockable seat 230. The locking pin 222 fits into a pin hole on the carriage 210. The seat support arm 234 provides support for pivoting, lockable seat 230. The seat support arm is attached to the pivot mechanism 215 (in this embodiment by a dual attachment in the outer ends of the pivot mechanism) which provides the pivot point for pivoting the seat 230 during hip thrust exercises. In some embodiments, pivot mechanism 215 may comprise a plurality of pivots (e.g., wherein the adjustable backrest 220 is attached to a first pivot and the pivoting, lockable seat 230 is attached to a second pivot). A hip attachment device 233 holds the pivoting, lockable seat 230 to the user's hips as the user raises and lowers his or her hips during exercise. Although a belt is shown in this embodiment, any device which holds the pivoting, lockable seat 230 to the user's hips may be used, such as a strap, rope, cable, bar, or pad. In this embodiment, the seat support arm is attached to the pivot point without an offset.

Figure 7:
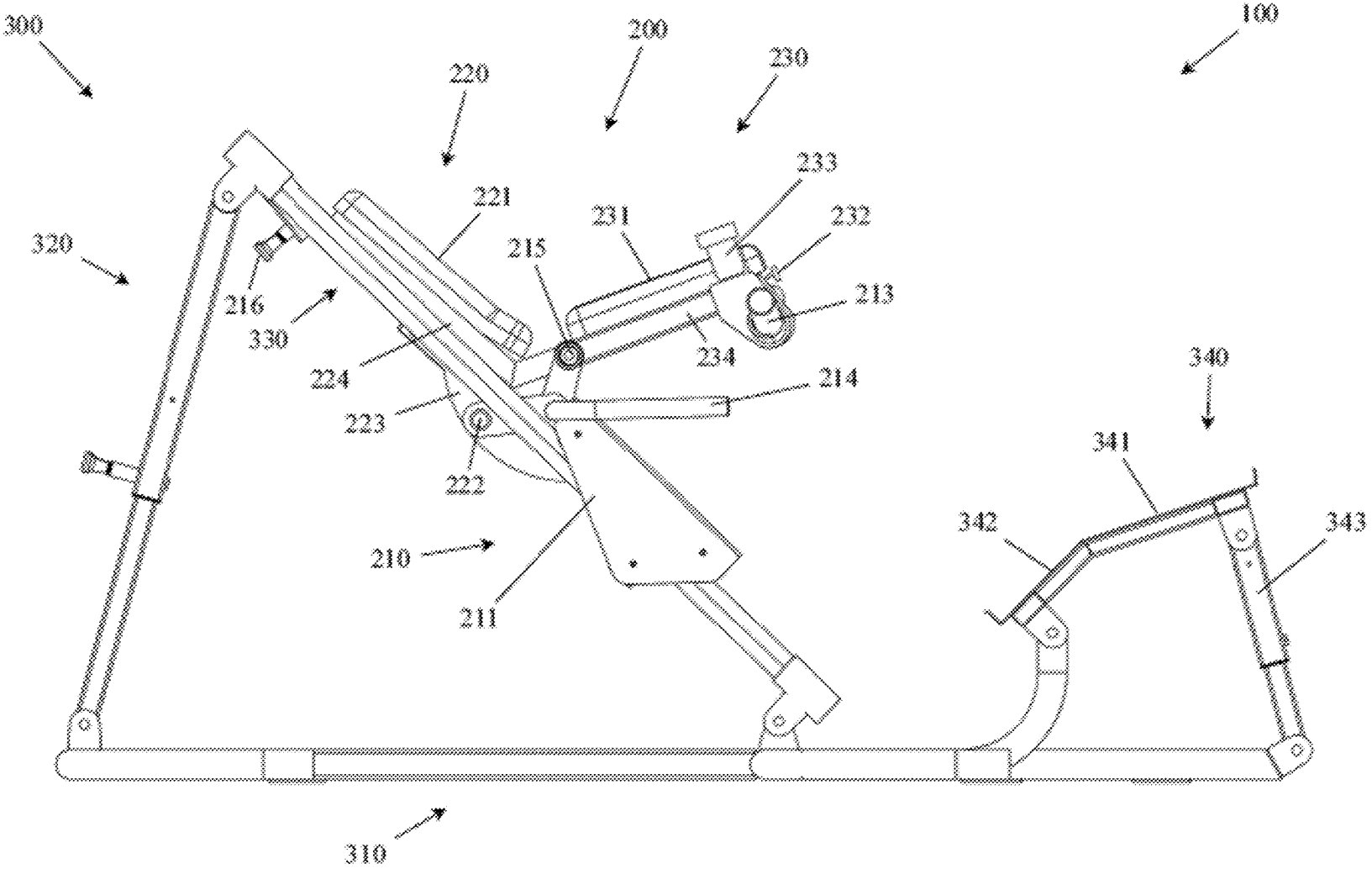
FIG. 7 is a side view of an exemplary embodiment of a combined leg press/hip thrust exercise machine showing the machine configured for hip thrust exercise.

FIG. 7 is a side view of an exemplary embodiment of a combined leg press/hip thrust exercise machine showing the machine configured for hip thrust exercise. This is a side view of the same configuration as in FIG. 6.

Figure 8:
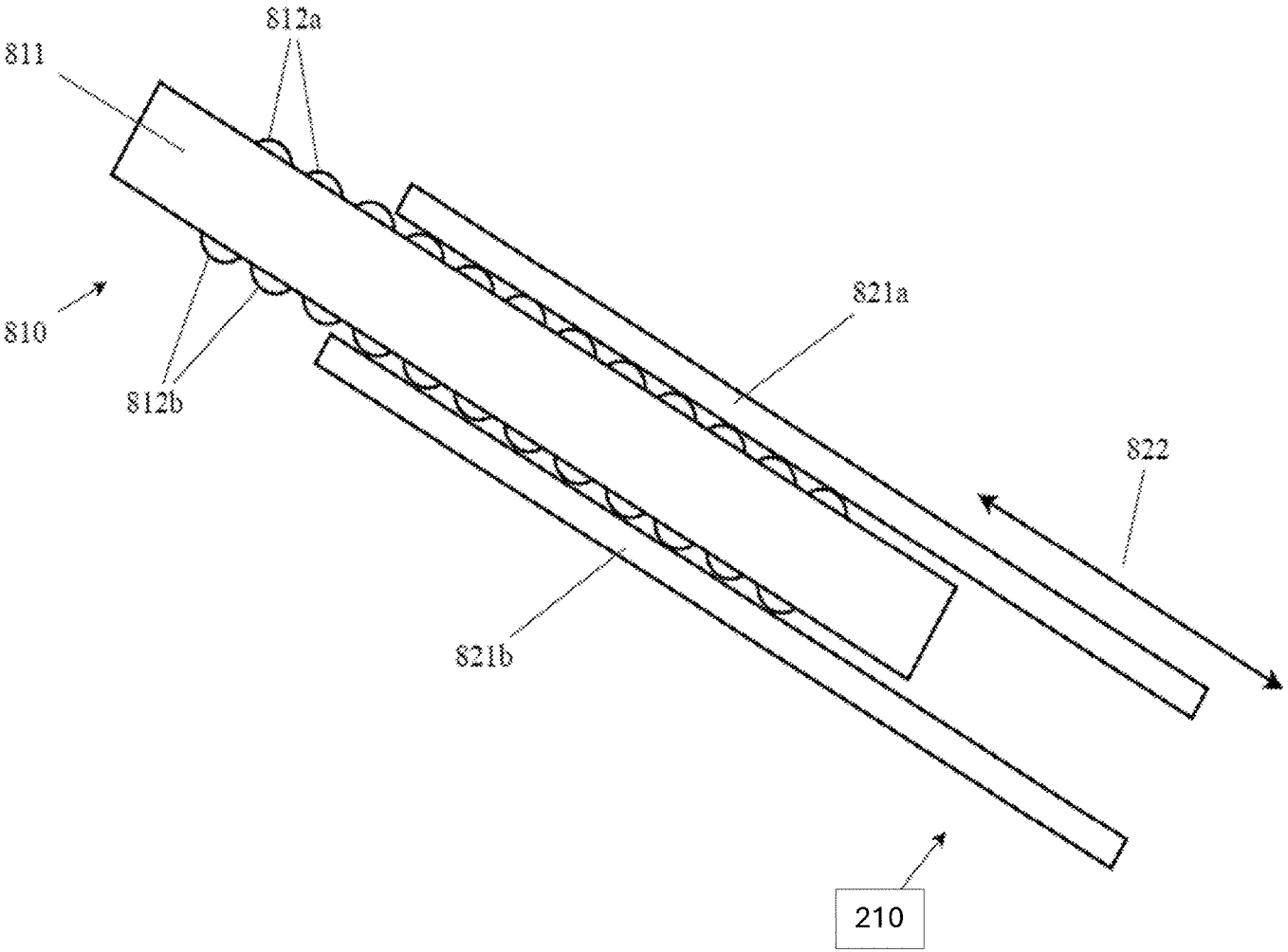
FIG. 8 is a side view diagram illustrating an exemplary alternate embodiment employing roller bearings as bearings between a slide rail and carriage.

FIG. 8 is a side view diagram illustrating an exemplary alternate embodiment employing roller bearings as bearings between a slide rail and carriage. In this embodiment, slide structure 810 comprises a slide rail 811 having a square or rectangular cross section into which are embedded a plurality of roller bearings 812*a*, 812*b* having a cylindrical shape, similar to those used, for example, underneath the belt of conveyor belts in many applications. A portion 821*a*, 821*b* of the carriage's 210 frame 211 rides along the roller bearings 812*a*, 812*b* allowing movement of the carriage 210 in the direction indicated by arrow 822. Roller bearings 812*a*, 812*b* and portions 821*a*, 821*b* of carriage 210 frame 211 may be on a single side of slide rail 811 or on a plurality of sides of slide rail 811, depending on configuration.

Figure 9:
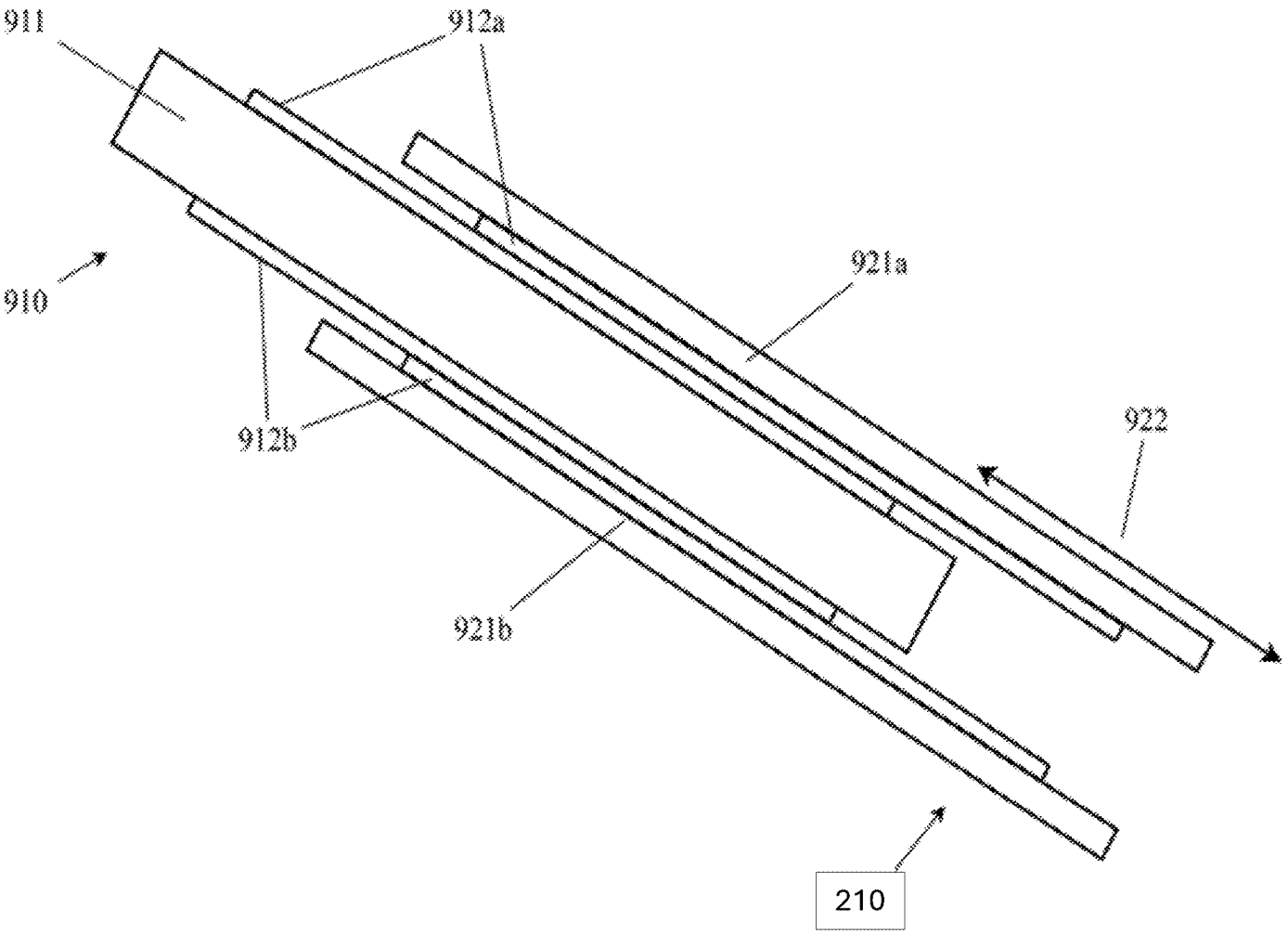
FIG. 9 is a side view diagram illustrating an exemplary alternate embodiment employing low-friction static materials as bearings between a slide rail and carriage.

FIG. 9 is a side view diagram illustrating an exemplary alternate embodiment employing low-friction static materials as bearings between a slide rail and carriage. Bearings employing low-friction static materials are often called plain bearings, slide bearings, or sliding contact bearings, and are often but not always lubricated. Low-friction static materials for use in bearings include but are not limited to such materials as steel, aluminum, brass, bronze, plastics such as high-density polyethelene (HDPE) and nylon, ceramics, Teflon®, and graphite. In this embodiment, slide structure 910 comprises a slide rail 911 having a square or rectangular cross section. The low-friction static materials 912*a*, 912*b* may be attached either to the slide rail 911, or to a portion 921*a*, 921*b* of the carriage's 210 frame 211, or to both. A portion 921*a*, 921*b* of the carriage's 210 frame 211 rides along the bearings 912*a*, 912*b* allowing movement of the carriage 210 in the direction indicated by arrow 922. Bearings 912*a*, 912*b* and portions 921*a*, 921*b* of carriage 210 frame 211 may be on a single side of slide rail 911 or on a plurality of sides of slide rail 911, depending on configuration.

Figure 10:
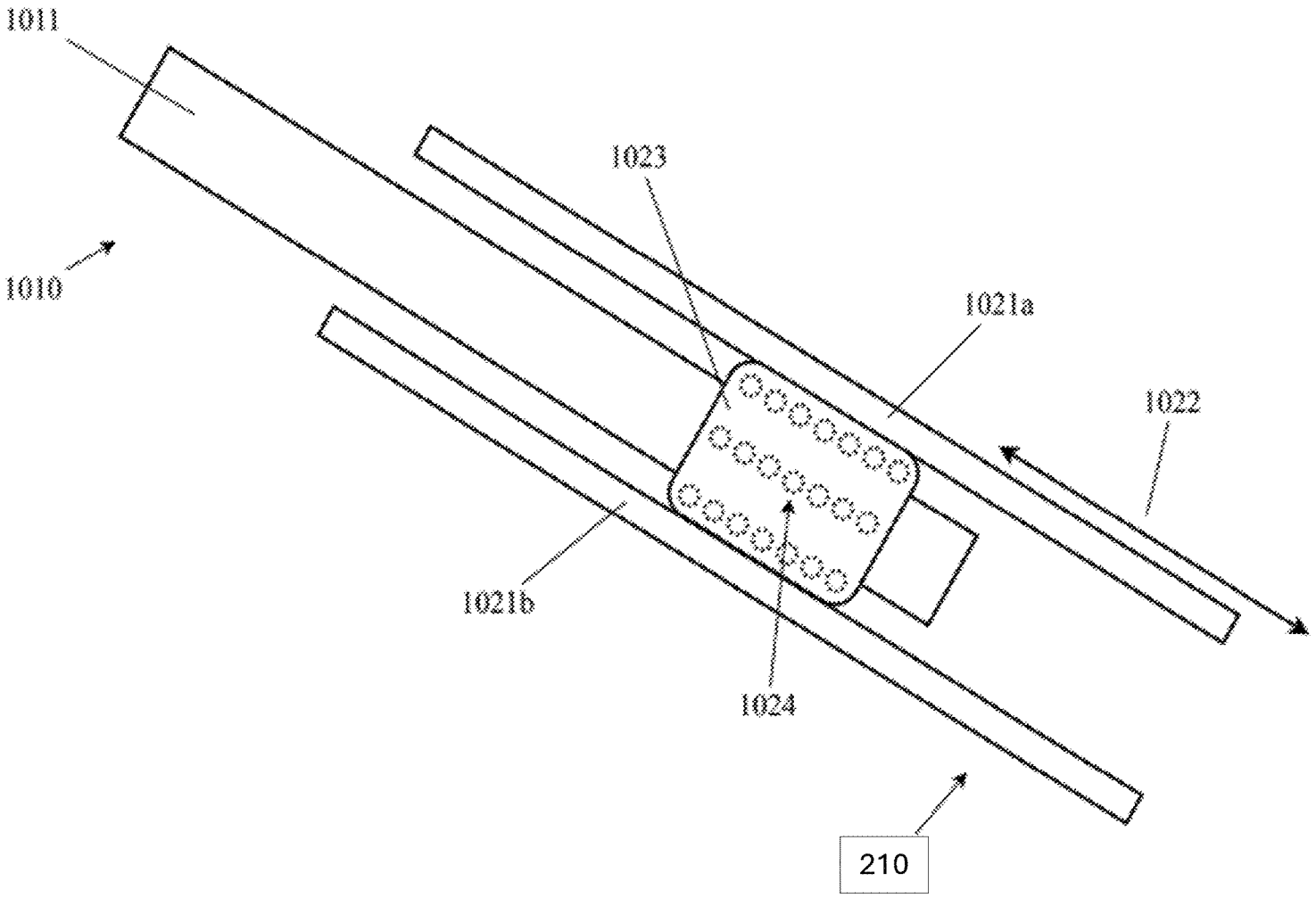
FIG. 10 is a side view diagram illustrating an exemplary alternate embodiment employing linear bearings as bearings between a slide rail and carriage.

FIG. 10 is a side view diagram illustrating an exemplary alternate embodiment employing linear bearings as bearings between a slide rail and carriage. In this embodiment, slide structure 1010 comprises a slide rail 1011 having a tubular cross section. Surrounding the circumference of the slide rail 1011 is a linear bearing 1023. Linear bearing may have an interior surface employing low-friction static materials in contact with the slide rail 1011 such as those described in FIG. 9, or may, as in this diagram, have a plurality of ball bearings 1024 embedded into the inner surface in contact with the slide rail 1011. The linear bearing is attached to a portion 1021*a*, 1021*b* of the carriage's 210 frame 211 such that the carriage 201 rides along the slide rail 1011 on the linear bearing 1023, allowing movement of the carriage 210 in the direction indicated by arrow 1022. Portions 1021*a*, 1021*b* of carriage 210 frame 211 may be on a single side of slide rail 1011 or on a plurality of sides of slide rail 1011, depending on configuration. Linear bearing 1023 may be configured to fully surround (as in this diagram) or partially surround the circumference of slide rail 1011. Where linear bearing 1023 fully surrounds slide rail 1011, attachment of a portion 1021*b* of carriage 210 frame 211 may not be necessary to hold carriage 210 to slide rail 211.

The skilled person will be aware of a range of possible modifications of the various aspects described above. Accordingly, the present invention is defined by the claims and their equivalents.

What is claimed is:

1. A combination leg press and hip thrust exercise machine, comprising:

a frame comprising an inclined slide structure comprising at least one slide rail;

an adjustable exercise bed comprising:

a carriage comprising:

a carriage frame configured to support an adjustable backrest and a pivoting, lockable;

seat;

one or more pivots configured to allow pivoting of the adjustable backrest and pivoting, lockable seat;

one or more bearings configured to allow the carriage to ride along the at least one slide rail of the inclined slide structure; and a seat locking pin hole for locking of the pivoting, lockable seat;

the adjustable backrest attached to the carriage at the one or more pivots, the adjustable backrest comprising a back rest pad, an angle locking pin, and an angle adjustment bracket comprising one or more holes, wherein:

insertion of the angle locking pin into a first hole of the one or more holes of the angle adjustment bracket causes the adjustable backrest to be placed into a raised position relative to the inclined slide structure; and removal of the angle locking pin from the first hole of the angle adjustment bracket allows the adjustable backrest to be placed into a flat position relative to the inclined slide structure; and the pivoting, lockable seat attached to the carriage at the one or more pivots, the pivoting, lockable seat comprising a seat pad, and a seat locking pin, wherein:

insertion of the seat locking pin into the seat locking pin hole of the carriage locks the pivoting, lockable seat into a flat position relative to the inclined slide structure; and removal of the seat locking pin from the seat locking pin hole of the carriage allows the pivoting, lockable seat to be raised upward relative to the inclined slide structure.

2. The machine of claim 1, further comprising a footpad against which a user of the exercise machine may push during exercise.

3. The machine of claim 2, wherein the footpad comprises a telescoping arm for changing an angle of the footpad.

4. The machine of claim 2, wherein the footpad comprises a dual-angled platform having a first portion of the platform at a flatter angle relative to the ground and a second portion of the platform at a steeper angle relative to the ground.

5. The machine of claim 1, further comprising one or more telescoping arms which allow the incline of the inclined slide structure to be changed.

6. The machine of claim 1, wherein the at least one slide rail of the inclined slide structure comprises a plurality of slide rails.

7. The machine of claim 1, wherein the inclined slide structure further comprises a slide locking pin and the adjustable backrest has a slide lock bracket comprising a slide lock hole wherein:

insertion of the slide locking pin into the slide lock hole causes the adjustable exercise bed to be locked in a fixed position along the inclined slide structure; and removal of the slide locking pin from the slide lock hole allows the adjustable exercise bed to move along the inclined slide structure.

8. The machine of claim 1, wherein the carriage further comprises weight plate holders for holding weight plates.

9. The machine of claim 1, wherein the one or more bearings of the carriage comprises a plurality of bearings, wherein:

at least a first bearing of the plurality of bearings rides on an underside of the at least one slide rail; and at least a second bearing of the plurality of bearings rides on a top side of the at least one slide rail.

10. The machine of claim 1, wherein:

the at least one slide rail of the inclined slide structure comprises a plurality of slide rails;

the one or more bearings of the carriage comprises a plurality of bearings;

at least a first set of bearings of the plurality of bearings rides on an underside of each of the plurality of slide rails; and at least a second set of bearings of the plurality of bearings rides on a top side of each of the plurality of slide rails.

11. The machine of claim 1, wherein the one or more pivots comprises a first pivot and a second pivot, wherein:

the adjustable backrest is attached to, and pivots at, the first pivot; and the pivoting, lockable seat is attached to, and pivots at, the second pivot.

12. The machine of claim 1, wherein the one or more bearings are selected from the list of wheels, roller-bearings, low-friction static materials, and linear bearings.

* * * * *